United States Patent [19]

Lucas

[11] Patent Number: 5,033,982

[45] Date of Patent: Jul. 23, 1991

[54] ELECTRICAL CONNECTOR

[75] Inventor: Derek A. Lucas, Tarpon Springs, Fla.

[73] Assignee: Sun Microstamping, Inc., Largo, Fla.

[21] Appl. No.: 531,522

[22] Filed: May 31, 1990

[51] Int. Cl.[5] ..... H01R 13/40

[52] U.S. Cl. ..... 439/750; 439/125; 439/752

[58] Field of Search ..... 439/125, 126, 127, 128, 439/279, 281, 282, 587, 701, 750, 851, 867, 921, 752

[56] References Cited

U.S. PATENT DOCUMENTS

| | | | |
|---|---|---|---|
| 2,071,572 | 2/1937 | Rabezzana et al. | 439/126 |
| 2,258,810 | 10/1941 | Rabezzana et al. | 439/126 X |
| 2,762,021 | 9/1956 | Battey et al. | 439/125 |
| 3,641,478 | 2/1972 | Savoca et al. | 439/598 |
| 3,914,003 | 10/1975 | Loy | 439/126 |
| 4,550,972 | 11/1985 | Romak | 439/843 X |
| 4,906,202 | 3/1990 | Germ | 439/127 |

*Primary Examiner*—Neil Abrams
*Assistant Examiner*—Khiem Nguyen
*Attorney, Agent, or Firm*—Herbert W. Larson

[57] ABSTRACT

A three component connector for use with high voltages. The connector is attached to a plastic cable enclosing multiple strand wire threaded through an inner shield of the connector. The plastic cable is stripped at its end to expose the multiple wires which are crimped to a pair of crimping arms integral with a barrel connector. A pair of strain relief arms, also integral with the barrel connector grip the plastic cable. The barrel connector is pulled into the inner shield. The inner shield is snapped to the outer shield by pushing it through an opening at a first end. At a second end of the outer shield an opening receives a male connector.

14 Claims, 2 Drawing Sheets

ELECTRICAL CONNECTOR

BACKGROUND OF THE INVENTION

1. Field of the Invention

This invention relates to electrical connectors. More particularly, it refers to high voltage receiving electrical connectors having a barrel contact and low insertion force.

2. Description of the Prior Art

Barrel contact elements having a necked down middle portion are known from U.S. Pat. Nos. 2,422,265; 3,538,491; 4,662,706 and 4,749,357. These contacts have been used in various manners from single female pin receptacles to buss contacts. Most of these prior uses have been as low voltage contacts. High voltage connectors generally have high insertion forces for contact reliability. Unfortunately, these high insertion forces diminish the number of male contacts that can be inserted with a single operation. A connector useful at high voltages with low insertion force and high contact reliability is needed.

SUMMARY OF THE INVENTION

I have invented an electrical connector employing a barrel contact integral with a wire crimping and strain relief element which permits low insertion force and significantly reduced voltage drop between female and male connectors.

My connector is a three component device having an outer plastic and inner plastic shield enclosing a beryllium copper spring alloy barrel contact integral with a wire crimping and strain relief element. A high voltage carrying multiple strand wire covered by a cross-linked polypropylene outer casing is threaded through the inner shield. The end of the wire casing is stripped away to expose the wire strands which are crimped by the crimping arms integral with the barrel contact. Another pair of upright arms acting as strain relief elements are crimped to the outer casing. The barrel connector is then retracted into the annular central opening in the inner plastic shield until a front end of the barrel connector is flush with the front end of the inner shield. Two pair of stops on an inner surface of the inner plastic shield prevent retraction of the barrel connector beyond its desired position. A ridge or ring on the outer surface of the inner shield snaps into a groove on an inner surface of the back portion of the outer shield to join the two shields together. The front portion of the outer shield receives a mating male connector which connects to the barrel connector to form a tight fit and a good electrical connection.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figures 1, 1A:
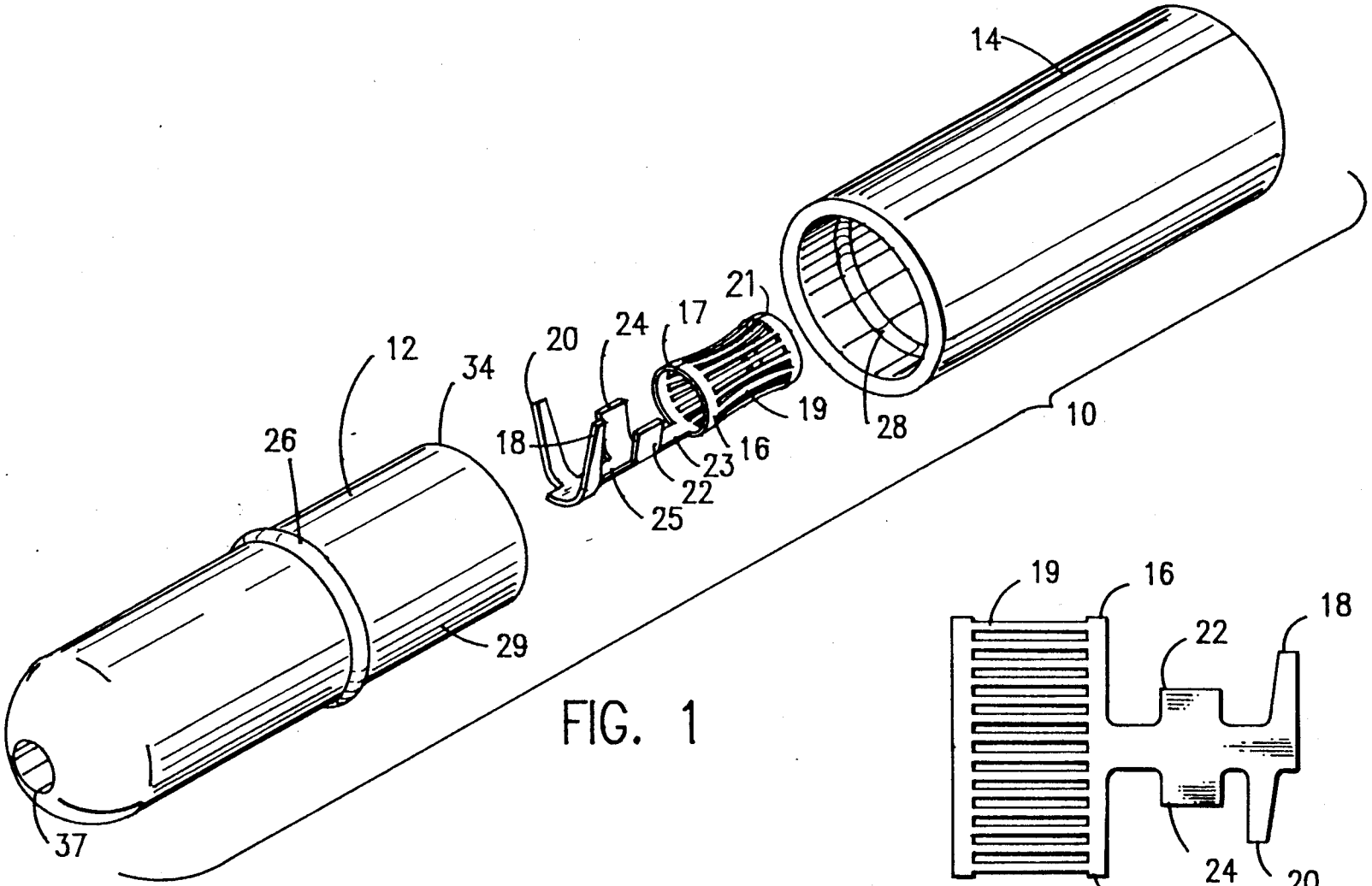
FIG. 1 is an exploded view of the three basic component parts of the electrical connector.
FIG. 1A is a plan view of a stamped barrel contact prior to forming.

The connector 10 shown in FIG. 1 has three major components; namely, the inner plastic shield 12, the outer plastic shield 14 and the barrel connector 16. The barrel connector 16 is rolled from a stamped out beryllium copper alloy as shown in FIG. 1A. The barrel portion of the connector has adjacent multiple longitudinal slats 19 integral with a ring 17 at the back end and a ring 21 at the front end of the barrel. The barrel portion of the connector is integral with a pair of upright strain relief arms 18 and 20 respectively and a pair of crimping arms 22 and 24 respectively. A bridge 23 joins the barrel portion of the connector with crimping arms 22 and 24 and bridge 25 joins the crimping arms 22 and 24 to the strain relief 18 and 20.

Figure 2:
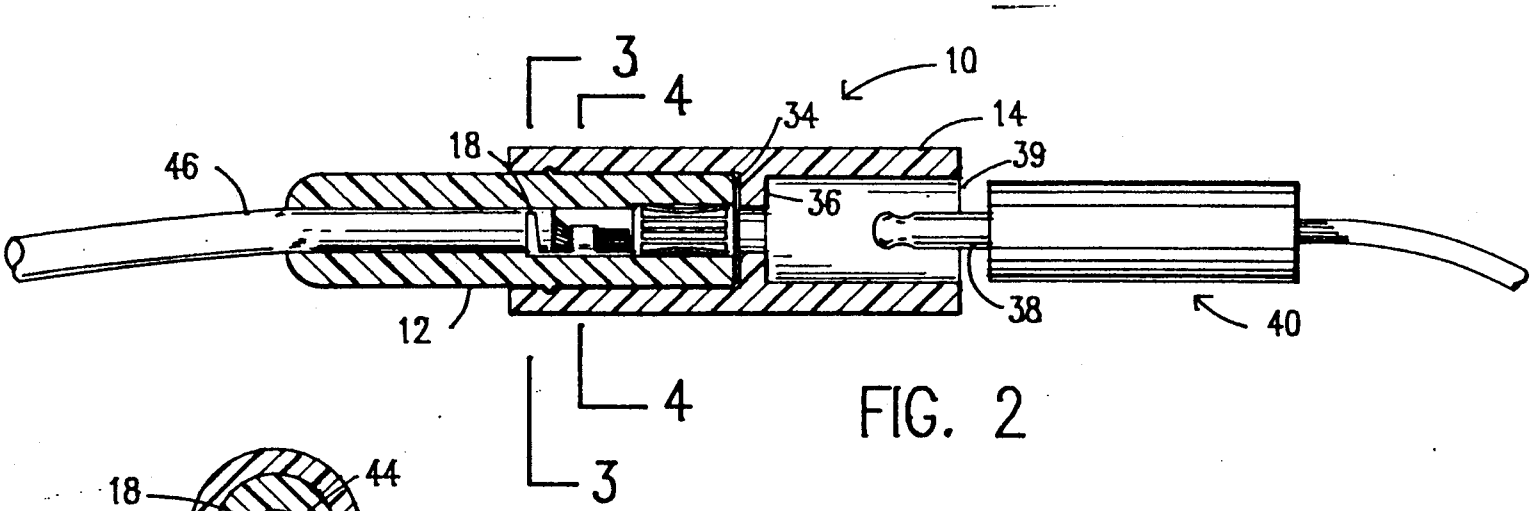
FIG. 2 is a cross sectional view of the connector joined together with its power cable and ready to receive a contact pin.
Figure 3:
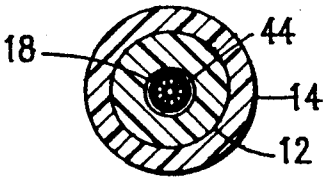
FIG. 3 is a sectional view of the electrical connector through lines 3—3 of FIG. 2.
Figure 4:
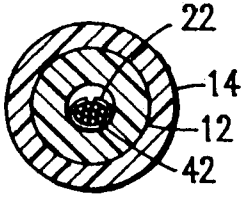
FIG. 4 is a sectional view of the electrical connector through lines 4—4 of FIG. 2.
Figure 5:
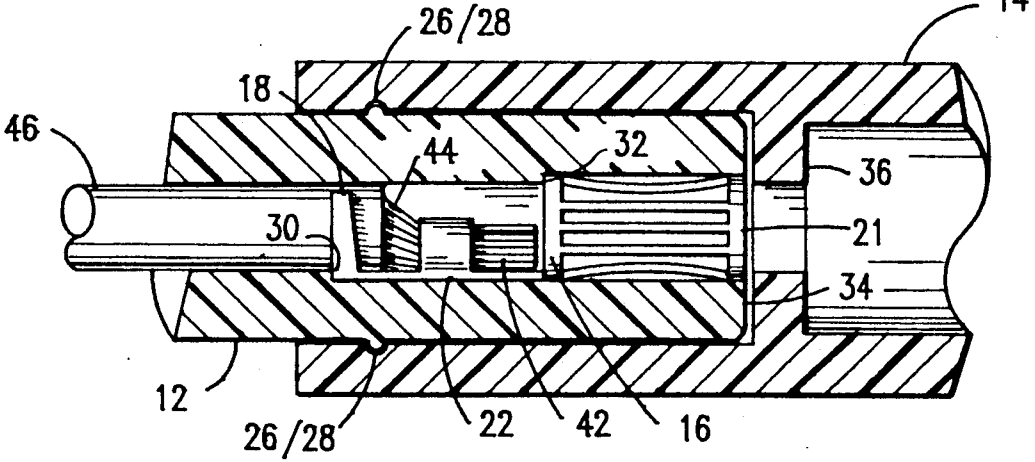
FIG. 5 is an enlarged cross sectional view of the cooperating elements of the connector.

The inner shield 12 is a plastic component having an annular opening 37 through which is fed a polypropylene coated cable 46 as seen in FIG. 2. The inner shield 12 has an outer ring 26 on its outer surface 29. The cable 46, containing multiple wire strands 44, is fed through an annular opening 37 and is crimped by arms 18 and 20 on the exterior surface of the cable 46. The outer casing of cable 46 is stripped at its end to expose wire strands 44. The exposed wire strands are thereafter crimped by arms 22 and 24 to give the wire crimped appearance 42 shown in FIG. 4. After the strain relief 18 and 20 and the crimp arms 22 and 24 are in place the wire cable 46 is pulled backwardly so that the barrel connector 16 is pulled into the inner-shield. Stops 30 and 32 located in the inner surface of opening 37 prevent the barrel connector 16 from being pulled too far backwards into the annular opening 37. The front end 21 of the barrel connector is approximately flush with the front end 34 of the inner-shield 12. The inner-shield 12 is then pushed into the outer shield 14 so that the ring 26 engages with the groove 28 in an inner surface of outer shield 14. Thereafter, the connector is ready for engagement with a male connector 38 which is attached to another connector 40. The male connector 38 is pushed in through opening 39 at the front end o the outer shield 14 and is pushed so that the connector 40 engages at its shoulders 48 with stops 36 on the inner surface of outer shield 14. At this point, the male connector 38 is engaged inside the barrel connector 16 and electrical contact is achieved.

The inner and outer plastic housing is made from a flame retardant polypropylene or other thermo-plastic. The barrel connector 16 is made from a beryllium copper spring alloy or phosphor bronze or other spring contact material. Two dissimilar metals can be used in the connector such as phosphor bronze for the barrel and brass or copper alloys for the crimping portion. The materials are joined by electron beam welding. The wire cable is made from polypropylene and contains multiple strands of copper wire. The electrical connector of this invention, can carry voltages in excess of 20,000, but will receive a male pin with a minimum of insertion force. Other equivalent materials can be substituted for the materials set forth above in order to make the connector of this invention.

Having thus described the invention, what is claimed and desired to be secured by Letters Patent is:

1. A high voltage carrying female electrical connector for receiving male pins comprising an inner thermo-plastic shield having an inner channel and an outer cylindrical thermo-plastic shield enclosing a portion of the inner shield, the inner plastic shield having a means on its outer surface for snapping into a groove on an interior surface of the outer shield, the inner plastic shield enclosing a metal female barrel connector, the connector having a necked down slated barrel portion connected by a first proximal bridge to a pair of wire crimping arms and by a second distal bridge to a pair of strain relief arms, the barrel portion of the connector capable of contacting a male pin, the outer shield enclosing the inner shield within a first interior channel and capable of enclosing a male connector within a second interior channel with a male pin of the male connector extending into the barrel portion, the first and second channels being open to each other, and a high voltage carrying cable engaged by the strain relief arms and interior wires of the cable exposed at an end of the cable crimped by the wire crimping arms.

2. The electrical connector of claim 1 wherein the means on the outer surface of the inner shield for snapping into the groove of the interior surface of the outer shield is a ring at right angles to the inner channel of the inner shield.

3. The electrical connector of claim 1 wherein the inner channel of the inner shield has a pair of stops to prevent the barrel connector from being pulled out from a rear end of the shield.

4. The electrical connector of claim 1 wherein the second interior channel of the outer shield has a stop proximal to the first channel to prevent further insertion of a male connector housing.

5. The electrical connector of claim 1 wherein the barrel connector is made from a beryllium copper spring alloy.

6. The electrical connector of claim 1 wherein the barrel connector is made from a phosphor bronze spring alloy.

7. The electrical connector of claim 1 wherein the barrel portion and the strain relief arms and crimping arms are made from dissimilar metals and are joined together by an electron beam weld.

8. The electrical connector of claim 1 wherein the outer and inner shields are made from a flame retardant polypropylene polymer.

9. Method of making the electrical connector of claim 1 wherein the parts are assembled by inserting the cable through the inner channel of the inner shield from a rear end to a front end, exposing the wire strands at an end of the cable and crimping the crimping arms to the wire strands while crimping the strain relief arms to the cable, thereafter pulling the cable backward so that the barrel connector is enclosed within the inner shield and thereafter inserting the inner shield within the first interior channel of the outer shield until it snaps in place.

10. A high voltage carrying female electrical connector for receiving male pins comprising an inner thermo-plastic shield having an inner annular channel and an annular ring on an outer surface at right angles to the inner channel, an outer thermo-plastic shield having a first inner channel with an inner annular groove therein for receiving the ring from the inner shield and a second inner channel open to the first channel for receiving another electrical connector housing, a metal barrel connector integral with a pair of strain relief arms and a pair of crimping arms, the connector being located in a front portion of the inner channel of the inner plastic shield, a wire cable enclosing multiple strand wire, the cable being stripped at an end to expose the multiple strand wire, the multiple strand wire being crimped together by the crimping arms and the wire cable being secured by the strain relief arms, the wire casing being located within the annular channel of the inner shield behind the barrel connector located within a front portion of the inner shield, the inner shield outer annular ring being engaged with the outer shield's inner annular groove through the first channel in the outer shield so that the outer shield, inner shield, wire cable and barrel connector are permanently joined together and a male connector can be connected to the barrel connector through the second channel in the outer shield.

11. An electrical connector according to claim 10 wherein a pair of stops within the inner shield prevents the barrel connector from being pushed backward from the front portion of the inner channel.

12. An electrical connector according to claim 10 wherein the barrel connector is made from a beryllium copper spring alloy.

13. An electrical connector according to claim 10 wherein the barrel connector is made from a phosphor bronze spring alloy.

14. An electrical connector according to claim 10 wherein the second interior channel of the outer shield has a stop proximal to the first channel to prevent further insertion of a male connector housing.

* * * * *